US012571215B2

(12) United States Patent
Lord et al.

(10) Patent No.: US 12,571,215 B2
(45) Date of Patent: Mar. 10, 2026

(54) SURFACE MOUNT CABLE INFILL SYSTEM

(71) Applicant: PrimeSource Building Products, Inc., Irving, TX (US)

(72) Inventors: Hung Wei Lord, Tampa, FL (US); E. Erik Timothy, Apollo Beach, FL (US)

(73) Assignee: PRIMESOURCE BUILDING PRODUCTS, INC., Irving, TX (US)

( * ) Notice: Subject to any disclaimer, the term of this patent is extended or adjusted under 35 U.S.C. 154(b) by 297 days.

(21) Appl. No.: 18/356,071

(22) Filed: Jul. 20, 2023

(65) Prior Publication Data

US 2024/0026687 A1 Jan. 25, 2024

Related U.S. Application Data

(60) Provisional application No. 63/369,116, filed on Jul. 22, 2022.

(51) Int. Cl.
*E04F 11/18* (2006.01)

(52) U.S. Cl.
CPC ..... *E04F 11/1817* (2013.01); *E04F 11/1859* (2013.01); *E04F 2011/1831* (2013.01)

(58) Field of Classification Search
CPC . E04F 11/1859; E04F 11/1817; E04F 15/146; E04F 15/06; E04F 2011/1821
USPC ..... 256/42, 37, 46
See application file for complete search history.

(56) References Cited

U.S. PATENT DOCUMENTS

| | | | | |
|---|---|---|---|---|
| 4,860,996 | A * | 8/1989 | Robbins, III | A01K 3/005 256/48 |
| 9,689,410 | B2 * | 6/2017 | Østervig | E04H 17/24 |
| 9,790,707 | B2 * | 10/2017 | Burt | E04F 11/1859 |
| 9,976,320 | B2 * | 5/2018 | Burt | E04F 11/1859 |
| 11,732,482 | B2 * | 8/2023 | Burt | E04F 11/1859 256/59 |
| 2005/0207838 | A1 * | 9/2005 | Striebel | E04F 11/1834 403/368 |
| 2011/0109025 | A1 * | 5/2011 | Sechler | F16F 7/00 256/22 |
| 2013/0099185 | A1 * | 4/2013 | Rountree | E04F 10/02 254/231 |
| 2016/0326768 | A1 * | 11/2016 | Schlatter | E04F 11/1859 |
| 2019/0352926 | A1 * | 11/2019 | Kennedy | E04H 17/12 |
| 2020/0399907 | A1 * | 12/2020 | Leary | F16B 5/0283 |
| 2024/0368895 | A1 * | 11/2024 | Storrer | E04F 11/1859 |
| 2024/0368913 | A1 * | 11/2024 | Miller | E04H 17/124 |

* cited by examiner

*Primary Examiner* — Daniel J Wiley
(74) *Attorney, Agent, or Firm* — Husch Blackwell LLP

(57) ABSTRACT

A method and a system for a cable infill system that may be used with a railing assembly for an elevated structure are provided. The cable infill system may include a first end-post fitting and a second end-post fitting, each configured to receive a tensioning fitting or a non-tensioning fitting therein for receiving a cable of the railing assembly. The first end-post fitting and the second end-post fitting may each be mounted to an outer surface of a first end-post and a second end-post of the railing assembly respectively. The cable infill system may further include one or more intermediate-post fittings and one or more corner-post fittings, each configured to be mounted on an outer surface of a intermediate-post or a corner-post of the railing assembly respectively. The cable infill system may further include a modular template to aid the installation of various fittings on the posts.

16 Claims, 14 Drawing Sheets

SURFACE MOUNT CABLE INFILL SYSTEM

CROSS-REFERENCE TO RELATED APPLICATION

This application claims the benefit of the filing date of U.S. Provisional Application Ser. No. 63/369,116 filed Jul. 22, 2022, entitled "Face Mount Stainless Steel Cable Infill System", which is hereby incorporated by reference as if fully set forth herein.

FIELD

This disclosure generally relates to a cable infill system for a railing assembly. More particularly, the disclosure relates to a cable infill system that is mountable to the outer surfaces of a railing assembly.

BACKGROUND OF THE INVENTION

Railing assemblies are frequently installed on the outer edges of elevated structures (e.g., decks, staircases, balconies, bridges, etc.) to act as a barrier to reduce the risk of a person or object falling off of the elevated structure. Railing assemblies typically include an infill system extending between two or more posts that are oriented vertically upright and coupled to the elevated structure or the ground.

Various infill systems including wood boards, metal bars, and architectural plastic pieces exist. However, many infill systems obstruct the view from the elevated structure. Because of this, cable infill systems are becoming an increasingly popular selection as an infill system for railing assemblies.

Cable infill systems are made up of one or more cables extending between the posts. The cables are commonly braided steel cables, although rope and other types of cable may also be used. Because the cables are thinner than other options for infill systems, cable infill systems offer improved visibility compared to other infill systems.

However, existing cable infill systems are not without deficiencies. For example, existing cable infill systems are burdensome and time-consuming to install. During the installation of cable infill systems, the cables are extended through openings positioned on the posts. Often, field personnel must drill the openings through the posts. In addition, the openings must be positioned and located consistently on each of the posts. If the openings are not positioned consistently, the openings on adjacent posts may be misaligned either vertically or horizontally. When the openings are misaligned, the cables may bend or curve as they extend from one post to another. This may detract from the visual appeal of the railing assembly. In addition, when the cables bend or curve, the cables may come into contact with the edges on the posts. The edges may exert a shear stress on the cables, and as a result, the cables may be damaged.

Moreover, existing cable infill systems require a large quantity of cable lengths. In existing cable infill systems, when the railing assembly changes direction or orientation, each length of cable must be terminated, and new lengths of cable must be installed to extend in the new direction or orientation. For example, at the corner of an elevated structure, the railing assembly may make a 90 degree turn. However, existing cable infill systems do not bend the cables around the corner of the railing assembly. Instead, existing cable infill systems include separate pieces of cable that extend from the corner of the railing assembly in each direction. Similarly, where railings assemblies change orientations (e.g., from flat to slanted due to a staircase), existing cable infill system include separate pieces of cable that extend in each orientation away from a post.

In addition, existing cable infill systems reduce the usable space of the elevated structure. For example, the posts of the railing assembly are typically installed with an outer surface of each post positioned and located at the outer perimeter of the structure, and an inner surface is positioned and located inward from the outer perimeter. Because the cables extend through the posts, the cables are positioned and located between the inner surface and the outer surface of the posts. As a result, the cables are positioned and located inward from the outer perimeter of the elevated structure. Therefore, because the cables are positioned and located inward from the outer perimeter of the structure, occupants are unable to access the outer perimeter of the deck. Thus, existing cable infill systems reduce the usable area of the structure.

Accordingly, there is a need for a cable infill system that is mountable on the outer surfaces of the posts in a railing assembly. Preferably, the cable infill system should be easy to align and install on the posts.

BRIEF SUMMARY OF THE INVENTION

A first aspect of this disclosure pertains to a cable infill system comprising a first end-post fitting configured to receive a first tensioning fitting or a first non-tensioning fitting for receiving a cable, wherein the first end-post fitting is configured to be mounted on an outer surface of a first end-post of a railing assembly.

A second aspect of this disclosure pertains to the cable infill system of the first aspect further comprising a second end-post fitting configured to receive a second tensioning fitting or a first non-tensioning fitting for receiving the cable, wherein the second end-post fitting is configured to be mounted on an outer surface of a second end-post of the railing assembly, thereby securing the cable on the railing assembly between the first end-post and the second end-post.

A third aspect of this disclosure pertains to the cable infill system of the second aspect, wherein the first end-post fitting and the second end-post fitting each comprising an aperture for receiving a tensioning fitting or a non-tensioning fitting; and a fastening hole for receiving a fastener, wherein the aperture and the fastening hole extend through the respective end-post fitting in different directions.

A fourth aspect of this disclosure pertains to the cable infill system of the first aspect further comprising an intermediate-post fitting configured to receive the cable through a cavity of the intermediate-post fitting, wherein the first end-post fitting is configured to be mounted on an outer surface of an intermediate-post of the railing assembly.

A fifth aspect of this disclosure pertains to the cable infill system of the fourth aspect, wherein the cavity of the intermediate-post fitting comprising a central bore provided in between two terminal portions, wherein each of the terminal portions extends from a surface of the intermediate-post fitting toward the central bore, and each of the terminal portions having a decreasing diameter from the surface toward the central bore.

A sixth aspect of this disclosure pertains to the cable infill system of the fifth aspect, wherein the central bore comprises a diameter that is generally uniform throughout a length of the central bore.

A seventh aspect of this disclosure pertains to the cable infill system of the fourth aspect, wherein the intermediate-post fitting further comprising a fastening hole for receiving a fastener, wherein the cavity and the fastening hole extend through the intermediate-post fitting in different directions.

An eighth aspect of this disclosure pertains to the cable infill system of the first aspect further comprising a corner-post fitting configured to guide the cable around a corner post of the railing assembly, wherein the corner-post fitting comprising a first leg and a second leg, wherein the first leg is configured to be mounted on a first outer surface of the corner post and the second leg is configured to be mounted on a second outer surface of the corner post.

A ninth aspect of this disclosure pertains to the cable infill system of the eighth aspect, wherein the first leg of the corner-post fitting includes a first fastening hole for receiving a first fastener and the second leg of the corner-post fitting includes a second fastening hole for receiving a second fastener.

A tenth aspect of this disclosure pertains to the cable infill system of the eighth aspect, wherein the first leg of the corner-post fitting includes a first cable opening and the second leg of the corner-post fitting include a second cable opening, wherein a channel is provided between the first cable opening and the second cable opening for receiving the cable within the corner-post fitting.

An eleventh aspect of this disclosure pertains to the cable infill system of the first aspect further comprising a template configured to position a plurality of end-post fittings, a plurality of intermediate-post fittings, or a plurality of corner-post fittings on a post of the railing assembly for mounting.

A twelfth aspect of this disclosure pertains to the cable infill system of the eleventh aspect, wherein the template is modular and comprising one or more intermediate modules, wherein a length of the template can be adjusted by adding or removing the one or more intermediate modules.

A thirteenth aspect of this disclosure pertains to a method for a cable infill system comprising providing a first end-post fitting configured to receive a first tensioning fitting or a first non-tensioning fitting for receiving a cable, wherein the first end-post fitting is configured to be mounted on an outer surface of a first end-post of a railing assembly.

A fourteenth aspect of this disclosure pertains to the method of the thirteenth aspect further comprising providing a second end-post fitting configured to receive a second tensioning fitting or a first non-tensioning fitting for receiving the cable, wherein the second end-post fitting mount is configured to be mounted on an outer surface of a second end-post of the railing assembly, thereby securing the cable on the railing assembly between the first end-post and the second end-post.

A fifteenth aspect of this disclosure pertains to the method of the thirteenth aspect further comprising providing an intermediate-post fitting to be mounted on an outer surface of an intermediate-post of the railing assembly, wherein the intermediate-post fitting includes a cavity to receive the cable therethrough.

A sixteenth aspect of this disclosure pertains to the method of the fifteenth aspect, wherein the cavity of the intermediate-post fitting comprising a central bore provided in between two terminal portions, wherein each of the terminal portions extends from a surface of the intermediate-post fitting toward the central bore, and each of the terminal portions having a decreasing diameter from the surface toward the central bore.

A seventeenth aspect of this disclosure pertains to the method of the thirteenth aspect further comprising providing a corner-post fitting configured to guide the cable around a corner post of the railing assembly, wherein the corner-post fitting comprising a first leg and a second leg, wherein the first leg is configured to be mounted on a first outer surface of the corner post and the second leg is configured to be mounted on a second outer surface of the corner post.

An eighteenth aspect of this disclosure pertains to the method of the thirteenth aspect further comprising providing a template configured to position a plurality of end-post fittings, a plurality of intermediate-post fittings, or a plurality of corner-post fittings on a post of the railing assembly for mounting.

A nineteenth aspect of this disclosure pertains to the method of the eighteenth aspect, wherein the template is modular and comprising one or more intermediate modules, wherein a length of the template can be adjusted by adding or removing the one or more intermediate modules.

A twentieth aspect of this disclosure pertains to a cable infill system comprising a first end-post fitting configured to receive a first tensioning fitting or a first non-tensioning fitting for receiving a cable, wherein the first end-post fitting is configured to be mounted on an outer surface of a first end-post of a railing assembly; a second end-post fitting configured to receive a second tensioning fitting or a first non-tensioning fitting for receiving the cable, wherein the second end-post fitting is configured to be mounted on an outer surface of a second end-post of the railing assembly, thereby securing the cable on the railing assembly between the first end-post and the second end-post; and an intermediate-post fitting configured to receive the cable through a cavity of the intermediate-post fitting, wherein the first end-post fitting is configured to be mounted on an outer surface of an intermediate-post of the railing assembly.

Figure 1:
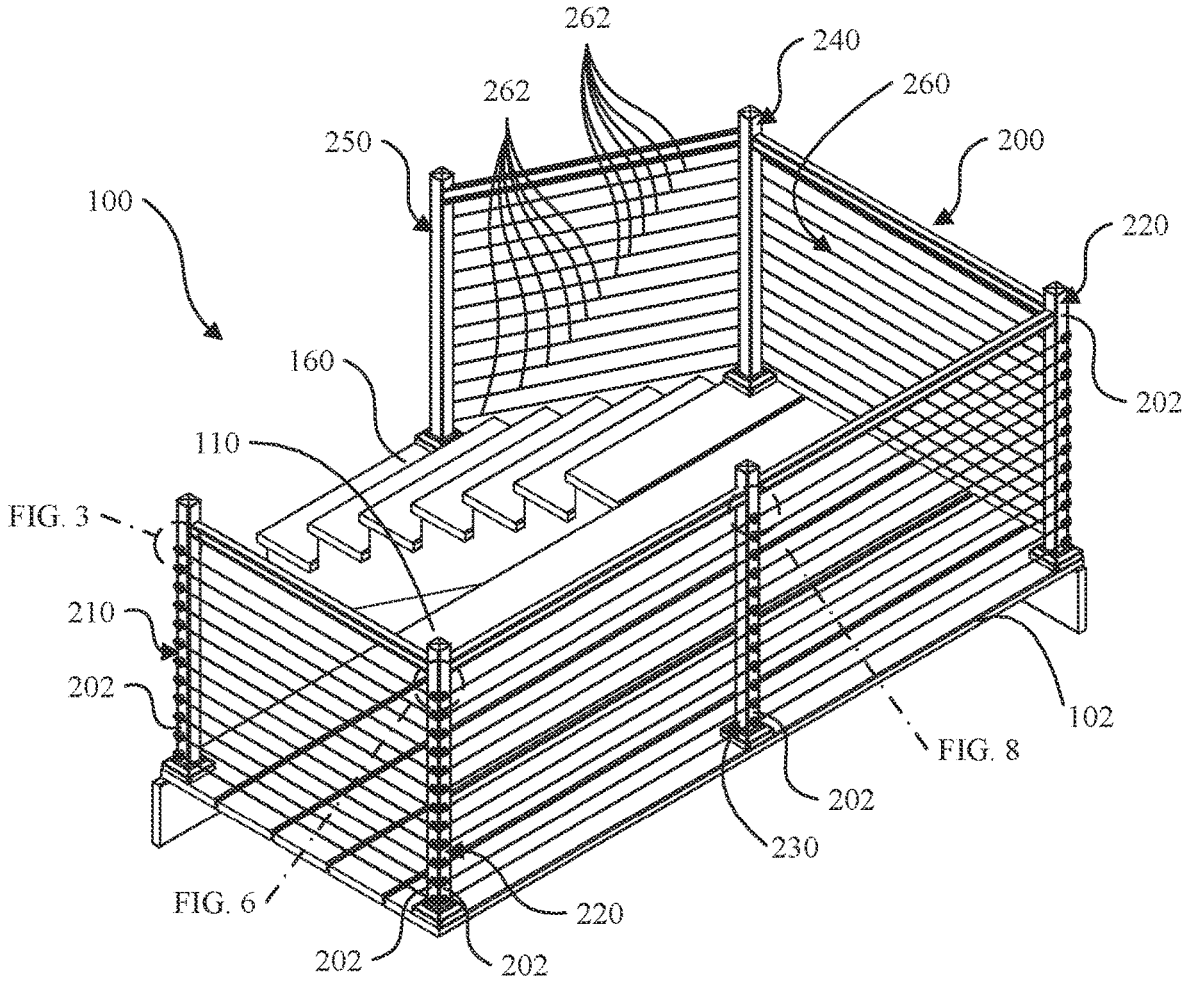
FIG. 1 illustrates a perspective view of a deck assembly with a cable infill system according to an embodiment.

Before explaining the disclosed embodiment of the subject disclosure in detail, it is to be understood that the invention is not limited in its application to the details of the particular arrangement shown, since the invention is capable of other embodiments. Example embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

While this invention is susceptible of embodiments in many different forms, there are shown in the drawings and will be described in detail herein specific embodiments with the understanding that the present disclosure is an exemplification of the principles of the invention. It is not intended to limit the invention to the specific illustrated embodiments. The features of the invention disclosed herein in the description, drawings, and claims may be significant, both individually and in any desired combinations, for the operation of the invention in its various embodiments. Features from one embodiment may be used in other embodiments of the invention.

Figure 13:
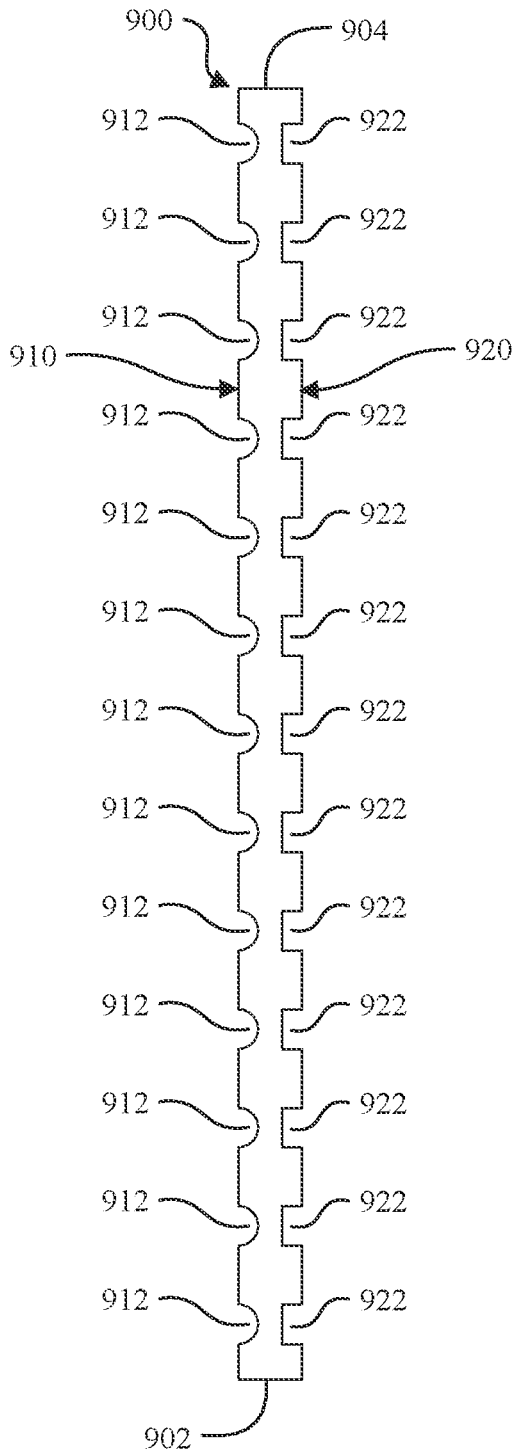
FIG. 13 illustrates a front side view of a template for the cable infill system of FIGS. 1 and 2.
Figure 14:
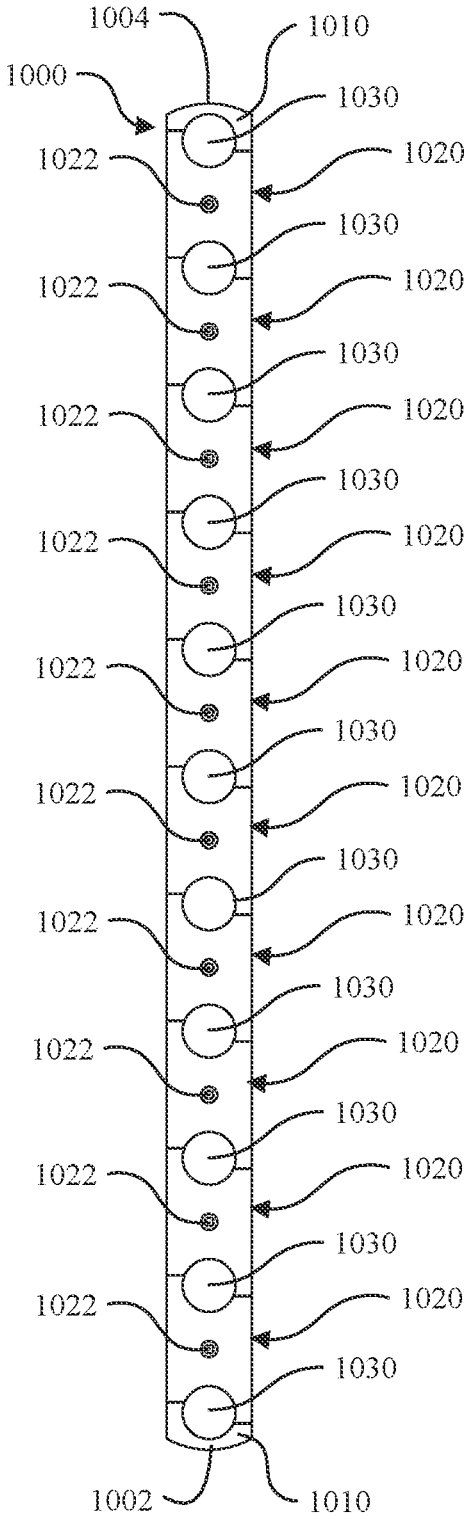
FIG. 14 illustrates a front side view of another template for the cable infill system of FIGS. 1 and 2.

As shown in FIGS. 1-12, embodiments of this disclosure include a cable infill system that can be installed on a railing assembly for a deck or other structures. As shown in FIGS. 13 and 14, embodiments of this disclosure may additionally include one or more templates to assist with installing the cable infill system.

Figure 2:
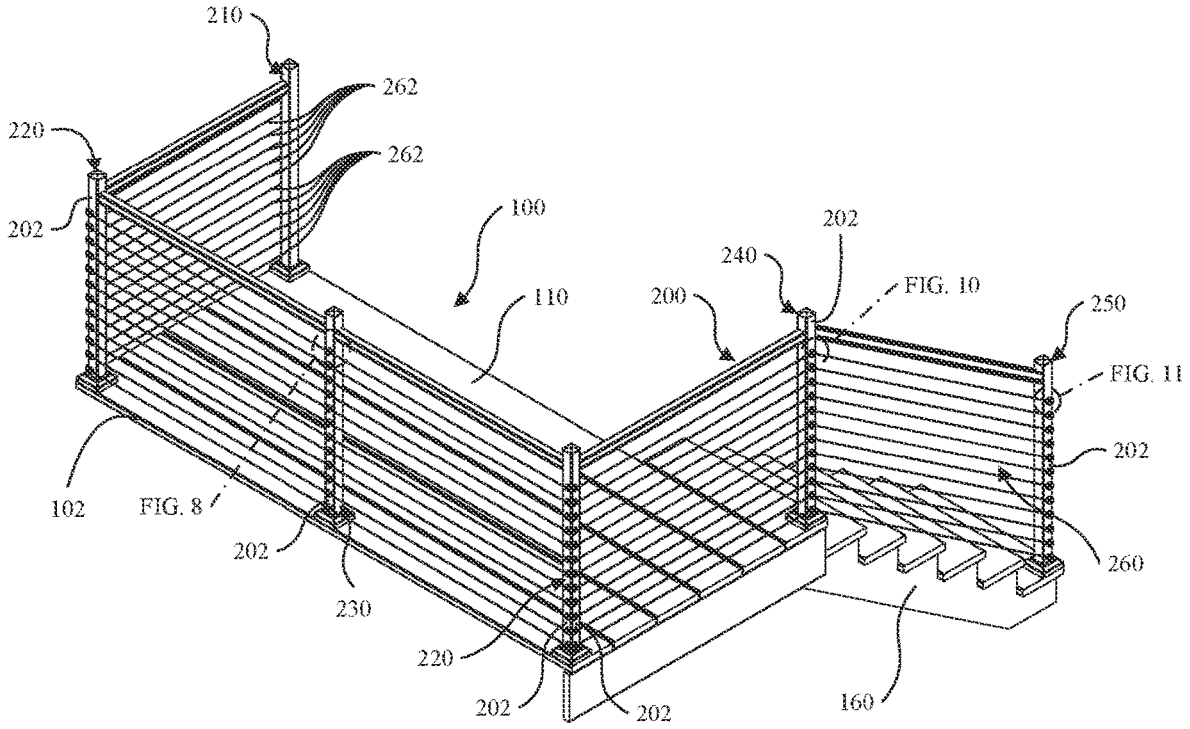
FIG. 2 illustrates another perspective view of the deck assembly and the cable infill system of FIG. 1.

Referring to FIGS. 1 and 2, a deck assembly 100 according to an embodiment may include a platform 110 and a staircase 160. The platform 110 may be substantially flat and may include one or more wood decking boards, although other suitable materials are also within the spirit of the disclosure.

The staircase 160 may be positioned adjacent to the platform 110, and the staircase 160 may extend in an angled or slanted direction up toward the platform 110. For example, the staircase 160 may extend in both of a horizontal direction (i.e., parallel to the platform 110) and a vertical direction (i.e., perpendicular to the platform 110). As a result, an occupant may travel up the staircase 160 to access the platform 110, and an occupant may travel down the staircase 160 to exit the platform 110. In alternative embodiments, the staircase 160 and the platform 110 may be alternatively configured, or there may be more or fewer platforms 110 and staircases 160 (e.g., in a multi-story stairwell with landings).

A railing system 200 may be positioned and located proximate to an outer perimeter 102 of the deck assembly 100. The railing system 200 may include a plurality of posts 210, 220, 230, 240, 250. For example, the railing system 200 may include a first end post 210, one or more corner posts 220, one or more intermediate posts 230, a staircase post 240, and a second end post 250. However, in alternative embodiments, the railing system 200 may include more or fewer of each of the posts 210, 220, 230, 240, 250. The first end post 210 and the second end post 250 may be positioned and located on opposing ends of the outer perimeter 102 of the deck assembly 100. The corner posts 220, intermediate post 230, and staircase post 240 may be positioned and located along the outer perimeter 102 between the end posts 210, 250.

Each of the posts 210, 220, 230, 240, 250 may be an elongated rectangular prism with one or more outer surfaces 202 positioned and located adjacent to the outer perimeter 102 of the deck assembly 100, although other suitable shapes for the posts 210, 220, 230, 240, 250 are also contemplated. In addition, the posts 210, 220, 230, 240, 250 may be oriented generally upright to extend upward and away from the deck assembly 100. The posts 210, 220, 230, 240, 250 may be made of wood, aluminum, stainless steel, plastic, concrete, a composite, or another suitable material. In addition, each of the posts 210, 220, 230, 240, 250 may be coupled to the deck assembly 100 as known in the art (e.g., by fasteners, brackets, etc.).

The railing system 200 may additionally include a cable infill system 260 including one or more cables 262. The one or more cables 262 may be stainless steel cables, although other suitable types of cable are likewise contemplated. The one or more cables 262 may each extend along the outer perimeter 102 of the deck assembly 100 to prevent a person or an object from falling off the deck assembly 100. For example, each of the cables 262 may be coupled to the end posts 210, 250, and the cables 262 may be guided along the outer perimeter 102 by the corner posts 220, the intermediate post 230, and the staircase post 240. Each of the cables 262 may be coupled to the posts 210, 220, 230, 240, 250, and the cables 262 may be spaced vertically along the length of the posts 210, 220, 230, 240, 250. As a result, each of the cables 262 may be oriented generally parallel to one another, and the cables 262 may be about equally spaced from one another.

Figure 3:
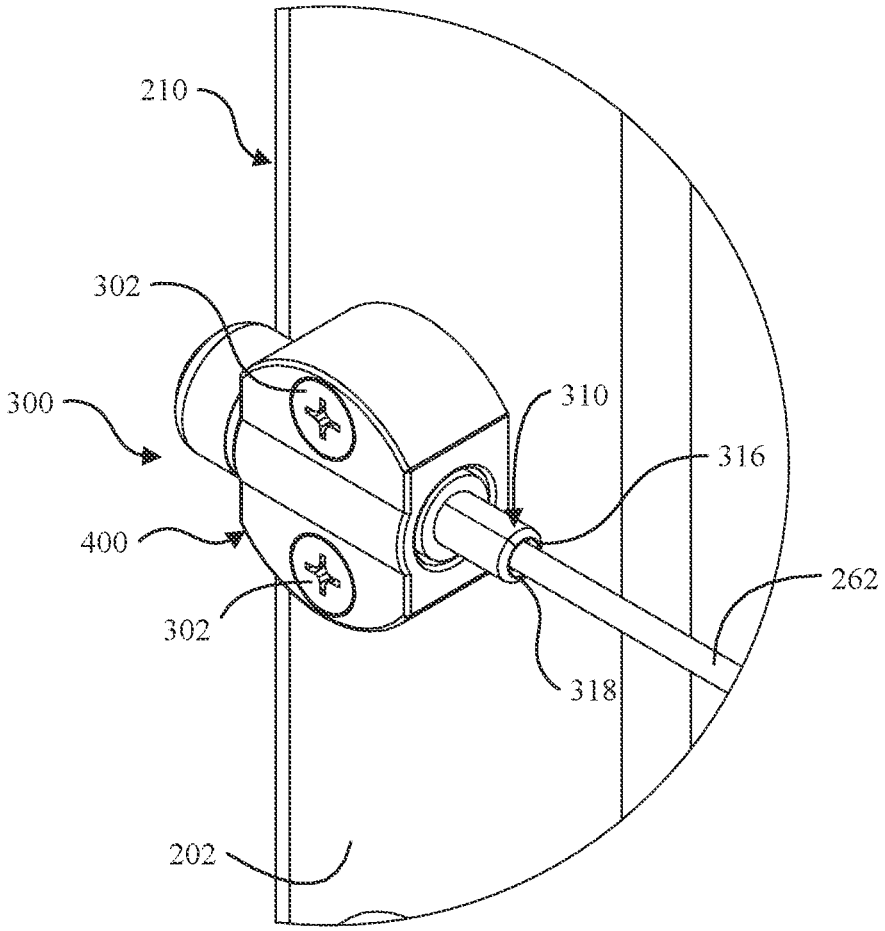
FIG. 3 illustrates an enlarged view of a first end post of the deck assembly of FIGS. 1 and 2 with a tensioning fitting mounted thereon.

Turning to FIG. 3, a tensioning fitting 300 may couple a cable 262 of the cable infill system 260 to the first end post 210. The tensioning fitting 300 may be positioned and located on the outer surface 202 of the first end post 210. The tensioning fitting 300 may be coupled to the first end post 210 through an end-post fitting 400. The end-post fitting may be affixed to the first end post 210 through one or more fasteners 302 (such as a screw, a nail, and the like). The one or more fasteners 302 may extend through the end-post fitting 400 and into the outer surface 202 of the post 210. However, in alternative embodiments, the tensioning fitting 300 may be coupled to the post 210 through other means, such as via welding, an adhesive, nails, machine screws, bolts, rivets, or other suitable fasteners.

Figure 4:
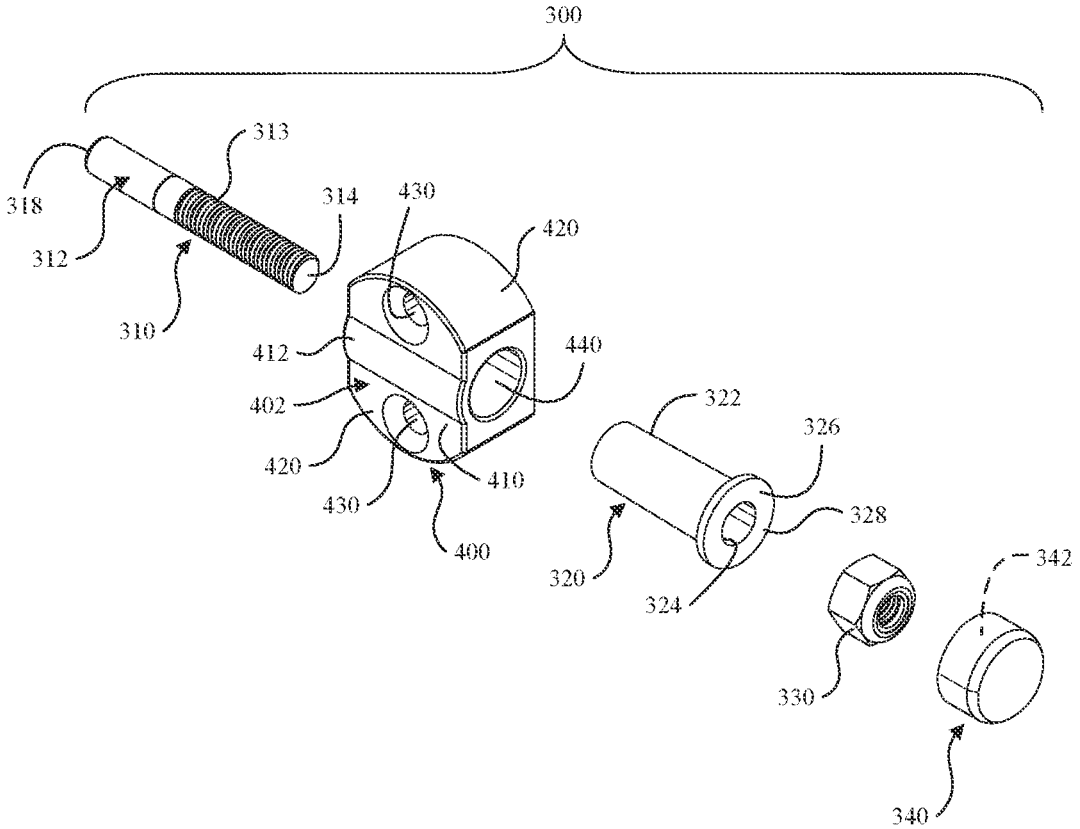
FIG. 4 illustrates an exploded view of the tensioning fitting of FIG. 3.
Figure 5:
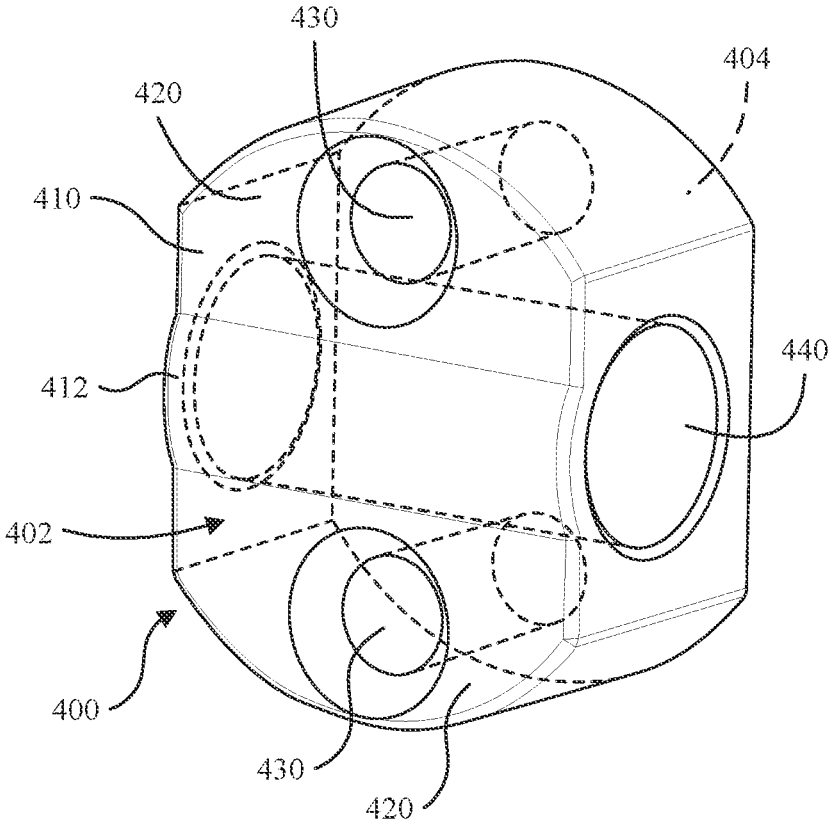
FIG. 5 illustrates a transparent perspective view of an end-post fitting of the tensioning fitting of FIGS. 3 and 4.

Referring to FIGS. 4 and 5, the end-post fitting 400 may be a solid-body member with a stadium shape. More particularly, the end-post fitting 400 may include a central portion 410 in between two end portions 420. Each of the end portions 420 may be semi-circular in shape and positioned and located on opposing sides of the central portion 410. The central portion 410 and the end portions 420 may be generally flat with a uniform thickness. As a result, the end-post fitting 400 may include a front surface 402 and a rear surface 404 (see FIG. 5) positioned and located opposite one another. The rear surface 404 may be substantially flat. However, in some embodiments, the front surface 402 may include a protrusion 412 on the central portion 410 of the end-post fitting 400. The protrusion 412 may be semi-cylindrical shaped, although other shapes are also foreseeable. The protrusion 412 may extend along the central portion 410 in between the end portions 420.

To couple the end-post fitting 400 to the first end post 210 (see FIG. 3), the one or more fasteners 302 may extend through one or more fastening holes 430 of the end-post fitting 400. The fastening holes 430 may be apertures extending through the front surface 402 and the rear surface 404 of the end-post fitting 400. Each of the fastening holes 430 may be sized and shaped to receive the fasteners 302, and in some embodiments, the fastening holes 430 may be counter-sunk. The end-post fitting 400 may include two of the fastening holes 430, although in alternative embodiments, the end-post fitting 400 may include more or fewer of the fastening holes 430. Each of the fastening holes 430 may be positioned and located on opposing ends of the end-post fitting 400. For example, each of the fastening holes 430 may be positioned and located proximal to one of the end portions 420.

Figure 12:
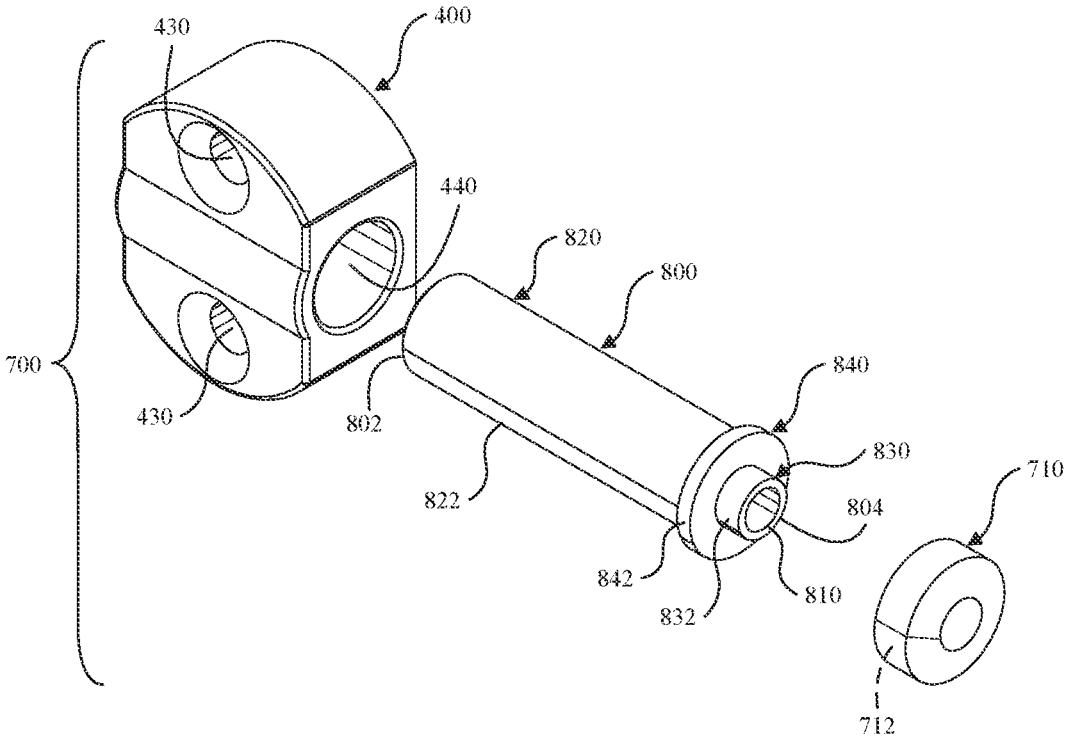
FIG. 12 illustrates an exploded view of the non-tensioning fitting of FIG. 11.

To couple the cable 262 to the end-post fitting 400, the end-post fitting 400 may include an aperture 440 for receiving hardware components which are coupled to the cable 262 (see, e.g., FIGS. 4 and 12). The aperture 440 may be circular and may extend through the central portion 410 in a direction generally parallel to the front surface 402 and the rear surface 404 of the end-post fitting 400. Furthermore, in some embodiments, the aperture 440 may extend in a direction generally parallel to the protrusion 412, and the aperture 440 may be positioned and located proximal to the protrusion 412.

Referring to FIGS. 3 and 4, the tensioning fitting 300 may include a threaded stud 310 for coupling the cable 262 to the end-post fitting 400. The threaded stud 310 may be a cylindrical member, although other suitable structures are also contemplated. An outer surface 312 of the threaded stud 310 may include a threaded region 313 at a distal end 314. In addition, the threaded stud 310 may include an opening 316 (see FIG. 3) positioned and located at a proximal end 318. The opening 316 may extend in an axial direction into the threaded stud 310.

The opening 316 may be sized and shaped for receiving the cable 262. For example, the opening 316 may be circular and sized to retain the cable 262 via a friction fit. Furthermore, in some embodiments, the opening 316 may include one or more ratchet teeth (not illustrated) configured to engage with the cable 262. For example, the ratchet teeth may be wedge-shaped protrusions, and the ratchet teeth may be coupled to a spring mechanism to allow for selective movement. Thus, the ratchet teeth may allow the cable 262 to be inserted into the opening 316, and the ratchet teeth may engage with the cable 262 to retain the cable 262 in the opening 316. Furthermore, in some alternative embodiments, the threaded stud 310 may be swaged or crimped around the cable 262 to couple the cable 262 to the tensioning fitting 300.

As further illustrated in FIG. 4, the tensioning fitting 300 may include a spacer 320 for receiving the threaded stud 310 within the aperture 440. The spacer 320 may be a tubular member with an outer diameter 322 and an inner diameter 324. The outer diameter 322 may include a circular shape that is smaller than the aperture 440. Thus, the spacer 320 may be received in the aperture 440. Moreover, the inner diameter 324 may include a circular shape that is larger than the outer surface 312 of the threaded stud 310. Thus, the threaded stud 310 may be extended through the inner diameter 324.

The spacer 320 may additionally include a flange 326 configured to retain the spacer 320 within the aperture 440. More particularly, the flange 326 may be positioned at a first end 328 of the spacer 320, and the flange 326 may include a circular shape that is larger than the aperture 440 in the end-post fitting 400. Thus, the spacer 320 is prevented from passing through the aperture 440. As a result, the flange 326 may be positioned and located outside of the aperture 440 and adjacent to the end-post fitting 400 when the tensioning fitting 300 is assembled.

When the tensioning fitting 300 is assembled, the threaded stud 310 may be retained in the spacer 320 by a lock nut 330 that is selectively engageable with the threaded region 313. More particularly, when the tensioning fitting 300 is assembled, the distal end 314 of the threaded stud 310 may extend through the flange 326 at the first end 328 of the spacer 320. Thus, the threaded region 313 of the threaded stud 310 may be positioned and located at least partially outside of the spacer 320. As a result, the lock nut 330 may be placed onto the threaded region 313 of the threaded stud 310. The lock nut 330 may be larger in size than the flange 326. Therefore, when the lock nut 330 is coupled to the threaded stud 310, the lock nut 330 is sized to prevent the distal end 314 of the threaded stud 310 from passing through the flange 326 and exiting the spacer 320. Accordingly, the lock nut 330 may retain the threaded stud 310 in the spacer 320 in the end-post fitting 400.

Moreover, when the tensioning fitting 300 is assembled, the lock nut 330 may be rotated to adjust the tension in the cable 262 (see, e.g., FIG. 3). As the lock nut 330 is rotated, the threaded region 313 of the threaded stud 310 may engage with the lock nut 330, and as a result, the threaded stud 310 may move relative to the lock nut 330. Because the lock nut 330 is positioned and located adjacent to the flange 326 of the spacer 320, rotating the lock nut 330 thereby causes the distal end 314 of the threaded stud 310 to move into or out from the aperture 440 in the end-post fitting 400. Moreover, because the proximal end 318 of the threaded stud 310 is coupled to the cable 262, the tension in the cable 262 may change when the threaded stud 310 moves. For example, if the lock nut 330 is rotated in a first direction, the threaded stud 310 may move away from the cable 262, and the tension in the cable 262 may increase. However, if the lock nut 330 is rotated in a second direction, the threaded stud 310 may move toward the cable 262, and the tension in the cable 262 may decrease.

The tensioning fitting 300 may additionally include a tensioner end cap 340. The tensioner end cap 340 may be a cylindrical member with an inner cavity 342. The inner cavity 342 may be circular and sized to receive the lock nut 330 and the distal end 314 of the threaded stud 310. As a result, the tensioner end cap 340 may be positioned and located on the lock nut 330 adjacent to the flange 326. Accordingly, the tensioner end cap 340 conceals and protects the lock nut 330 and the distal end 314 of the threaded stud 310.

Figure 6:
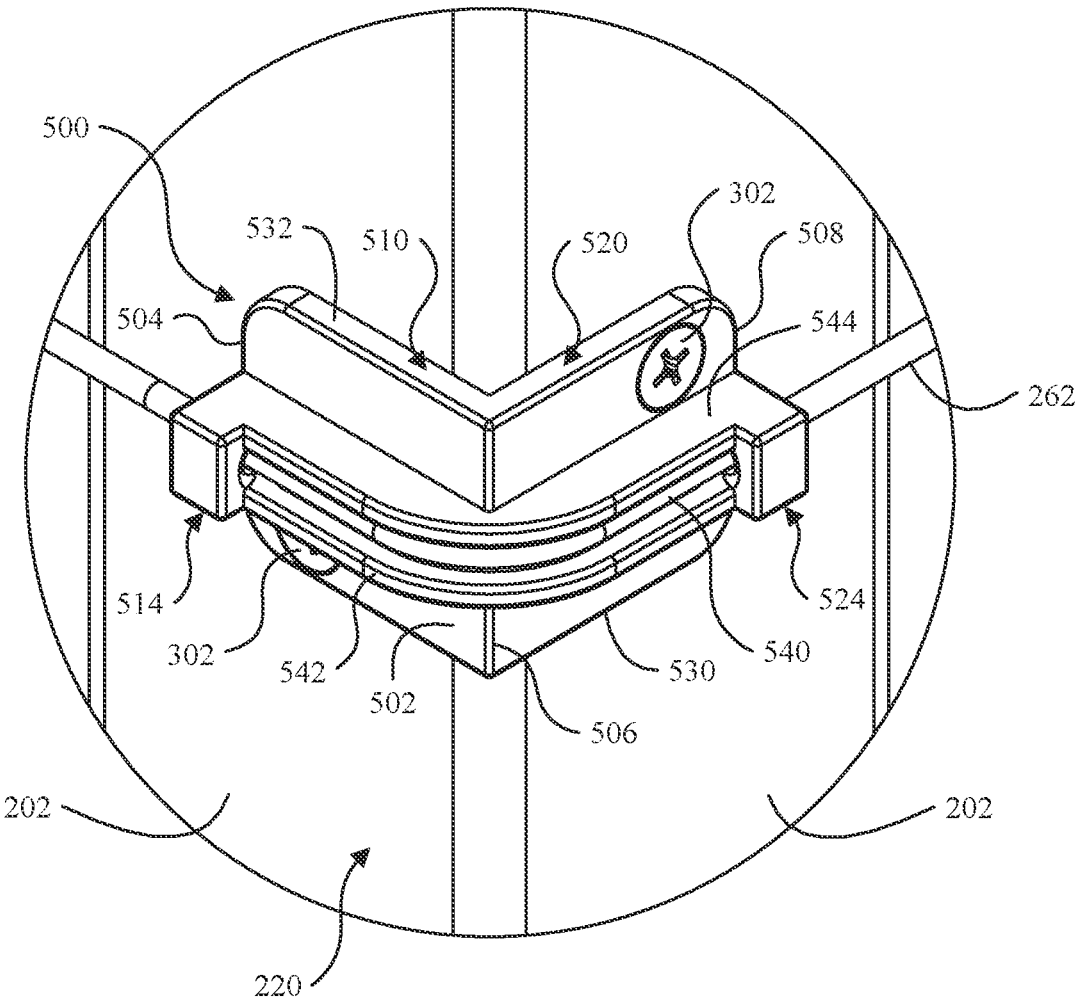
FIG. 6 illustrates an enlarged view of a corner post of the deck assembly of FIGS. 1 and 2 with a corner-post fitting mounted thereon.
Figure 7A:
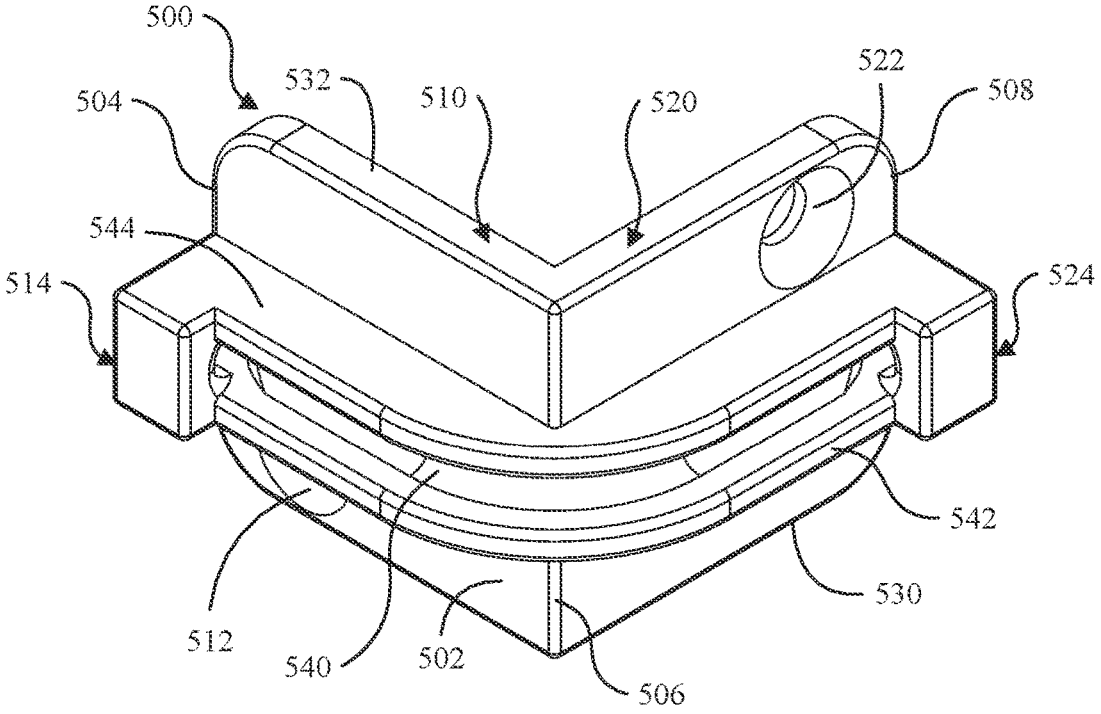
FIG. 7A illustrates a perspective view of the corner-post fitting of FIG. 6.
Figure 7B:
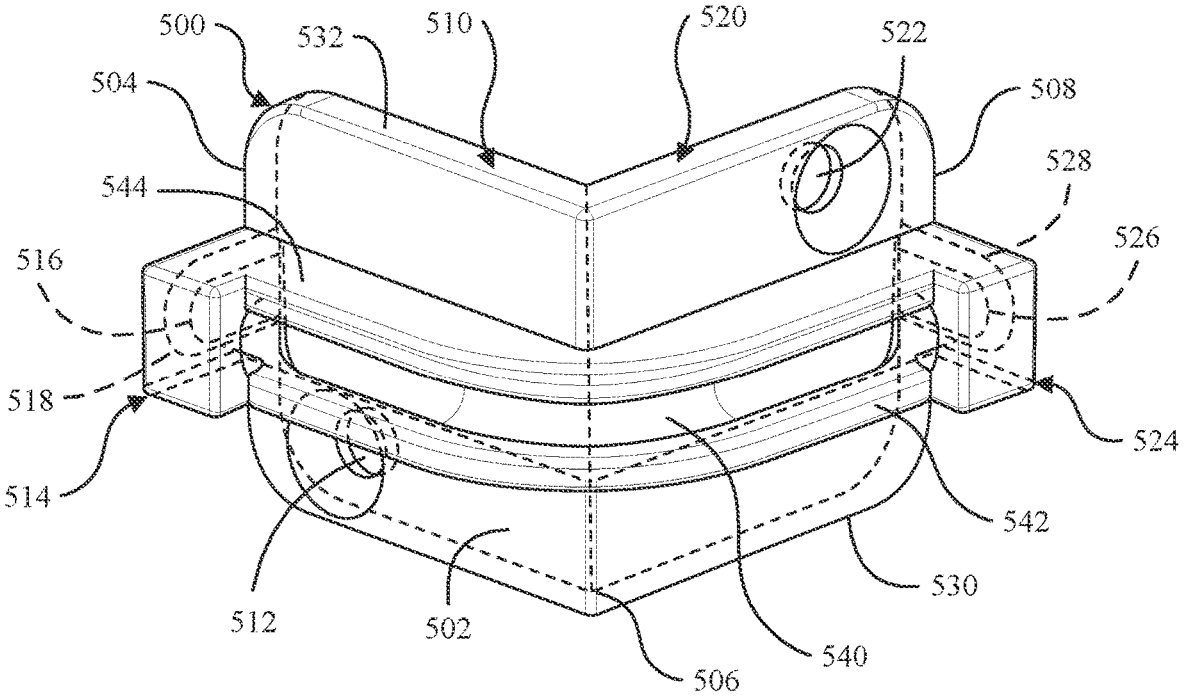
FIG. 7B illustrates a transparent perspective view of the corner-post fitting of FIGS. 6 and 7A.

Referring to FIGS. 6, 7A, and 7B, a corner-post fitting 500 for coupling a cable 262 to one of the corner posts 220 is illustrated. The corner-post fitting 500 may be positioned and located on two of the outer surfaces 202 of the corner post 220. For example, the corner-post fitting 500 may include a first leg 510 and a second leg 520 each positioned and located on one of the outer surfaces 202 of the corner post 220.

The first leg 510 and the second leg 520 may be substantially flat and rectangular. Moreover, the first leg 510 and the second leg 520 may be joined together and may be oriented generally perpendicular to one another. As a result, the first leg 510 and the second leg 520 may define an outer surface 502 of the corner-post fitting 500 that is L-shaped. More particularly, the first leg 510 may extend from a first end 504 of the corner-post fitting 500 to a corner region 506, and the second leg 520 may extend from the corner region 506 to a second end 508 of the corner-post fitting 500. However, in other embodiments, the legs 510, 520 may be alternatively shaped or configured depending on a shape of the corner posts 220.

The corner-post fitting 500 may be coupled to the corner post 220 by one or more fasteners 302, although, in alternative embodiments, the corner-post fitting 500 may be alternatively coupled to the corner post 220 using other foreseeable means. The corner-post fitting 500 may include a first fastening hole 512 positioned and located on the first leg 510 and a second fastening hole 522 positioned and located on the second leg 520. The first fastening hole 512 may be positioned proximate to a lower end 530 of the corner-post fitting 500, and the second fastening hole 522 may be positioned proximate to an upper end 532 of the corner-post fitting 500. However, in alternative embodiments, the corner-post fitting 500 may include more or fewer of the fastening holes 512, 522. Each of the fastening holes 512, 522 may be sized and shaped to receive one of the fasteners 302. For example, each of the fastening holes 512, 522 may be substantially circular and may be counter-sunk. As a result, one of the fasteners 302 may extend through the first leg 510 into the corner post 220, and another one of the fasteners 302 may extend through the second leg 520 into the corner post 220. Thus, the corner-post fitting 500 may be coupled to the corner post 220 on at least two sides of the corner post 220.

The corner-post fitting 500 may direct the cable 262 around the corner post 220 from the first end 504 of the corner-post fitting 500 to the second end 508. For example, the corner-post fitting 500 may include a first cable receiving member 514 and a second cable receiving member 524. Each of the cable receiving members 514, 524 may be a rectangular protrusion extending outward from the outer surface 502 of the corner-post fitting 500. The first cable receiving member 514 may be positioned and located on the first leg 510 proximate to the first end 504 of corner-post fitting 500, and the second cable receiving member 524 may be positioned and located on the second leg 520 proximate to the second end 508 of the corner-post fitting 500.

The cable 262 may extend through a first cable opening 516 (see FIG. 7B) in the first cable receiving member 514 and through a second cable opening 526 (see FIG. 7B) in the second cable receiving member 524. Each of the cable openings 516, 526 may be an elliptical or circular opening. Additionally, each of the cable openings 516, 526 may include a beveled edge 518, 528, for guiding the cables 262 into the cable openings 516, 526 without the risk of a sharp edge damaging the cable 262. However, other shapes and configurations for the cable openings 516, 526 are foreseeable.

To further guide the cable 262 around the corner post 220, the corner-post fitting 500 may include a channel 540. The channel 540 may extend along the outer surface 502 of the corner-post fitting 500 from the first cable receiving member 514 to the second cable receiving member 524. Moreover, the channel 540 may be sized and shaped to retain the cable 262 in the channel 540. For example, the channel 540 may include a semi-circular cross-section defined at least in part by a lower wall 542, an upper wall 544, and the outer surface 502. The lower wall 542 may be positioned and located proximate to the lower end 530 of the corner-post fitting 500, and the upper wall 544 may be positioned and located proximate to the upper end 532 of the corner-post fitting 500. The lower wall 542 and the upper wall 544 may each protrude away from the outer surface 502 of the corner-post fitting 500. Thus, the cable 262 may be retained in the channel 540 by the lower wall 542 and the upper wall 544.

Proximal to the corner region 506, the channel 540 may be substantially L-shaped. In addition, the lower wall 542, the upper wall 544, and the outer surface 502 may be curved or rounded proximate to the corner region 506. Thus, the channel 540 may be rounded, and the cable 262 may be guided around the corner post 220 without pointed edges.

Figure 8:
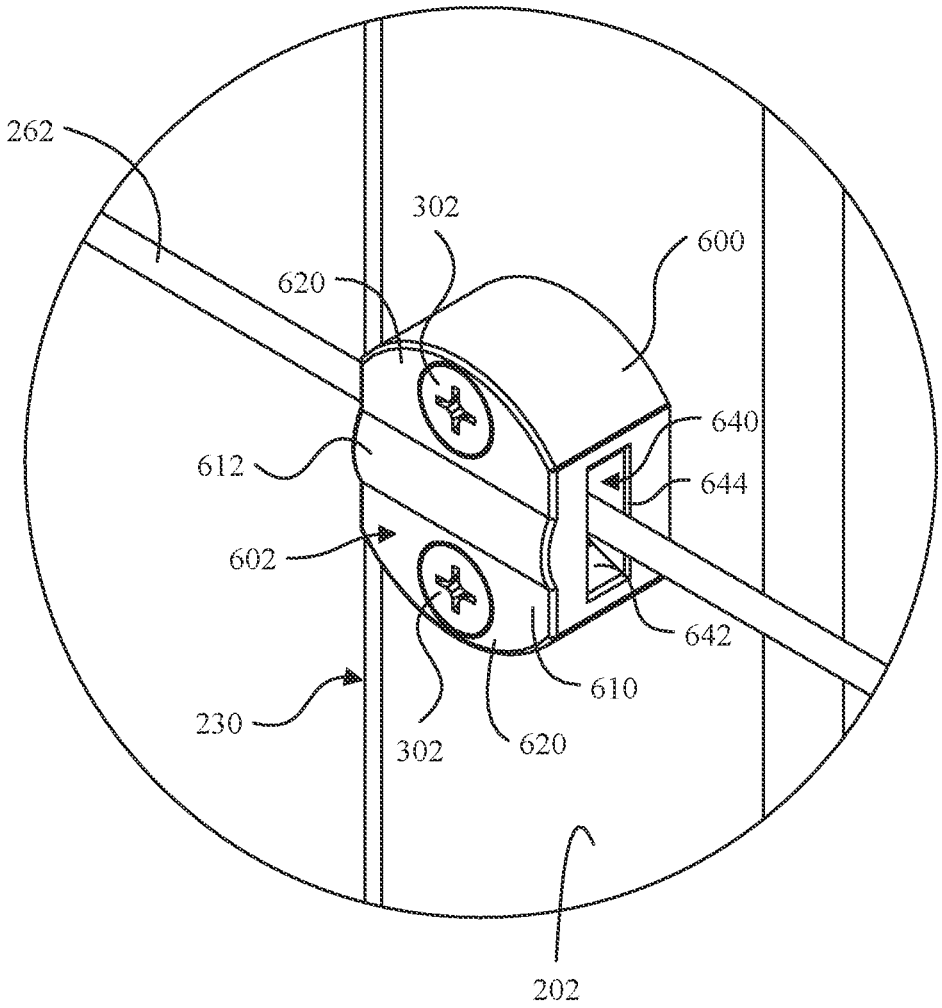
FIG. 8 illustrates an enlarged view of an intermediate post of the deck assembly of FIGS. 1 and 2 with an intermediate-post fitting mounted thereon.
Figure 9:
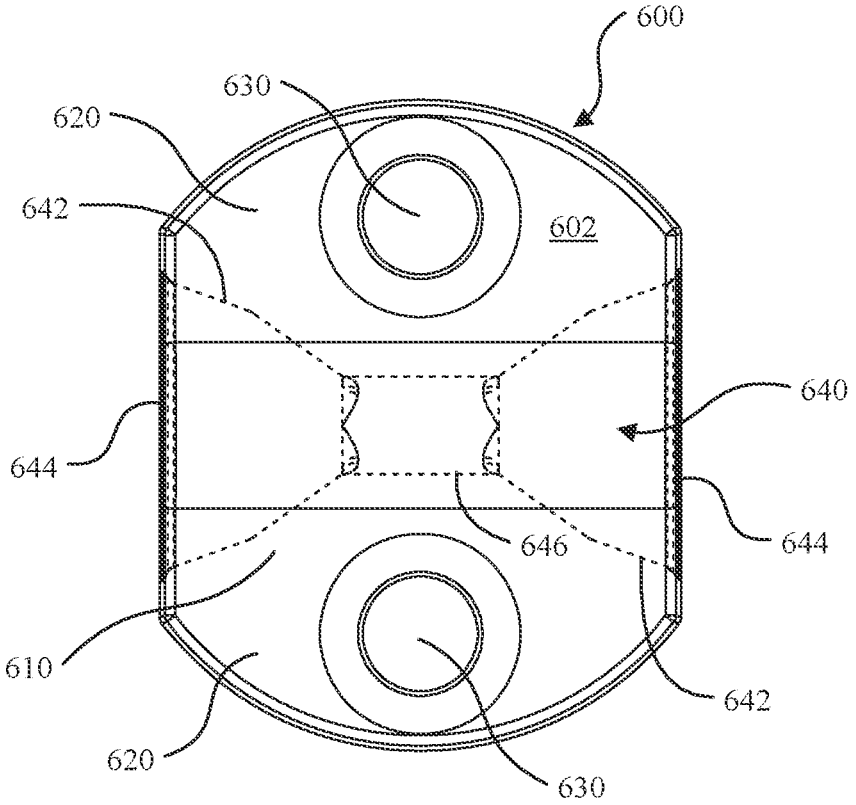
FIG. 9 illustrates a transparent front side view of the intermediate-post fitting of FIG. 8.

As illustrated in FIGS. 8 and 9, a cable 262 of the cable infill system 260 may be coupled to one of the intermediate posts 230 by an intermediate-post fitting 600. The intermediate-post fitting 600 may be positioned and located on the outer surface 202 of the intermediate post 230. The intermediate-post fitting 600 may be coupled to the intermediate post 230 by one or more fasteners 302 which extend through the intermediate-post fitting 600 and into the intermediate post 230.

The intermediate-post fitting 600 may be a solid body member with a stadium-shape, although other shapes are foreseeable. More particularly, the intermediate-post fitting 600 may include a central portion 610 and two end portions 620. Each of the end portions 620 may be positioned and located on opposing sides of the central portion 610. The central portion 610 and the end portions 620 may be generally flat with a uniform thickness. Thus, the intermediate-post fitting 600 may include a front surface 602 and a rear surface (not illustrated) positioned and located opposite from one another. The rear surface may be substantially flat. However, in some embodiments, the front surface 602 may include a protrusion 612 on the central portion 610 of the intermediate-post fitting 600. The protrusion 612 may be semi-cylindrical shaped, although other shapes are also foreseeable.

To couple the intermediate-post fitting 600 to the intermediate post 230, the fasteners 302 may extend through fastening holes 630 of the intermediate-post fitting 600. The fastening holes 630 may be sized and shaped to receive the fasteners 302, and in some embodiments, the fastening holes 630 may be counter-sunk. The intermediate-post fitting 600 may include two of the fastening holes 630, although in alternative embodiments, the intermediate-post fitting 600 may include more or fewer of the fastening holes 630. Each of the fastening holes 630 may be positioned and located on opposing ends of the intermediate-post fitting 600. For example, each of the fastening holes 630 may be positioned and located proximal to one of the end portions 620.

The cable 262 may be coupled to the intermediate-post fitting 600 by way of a cavity 640. The cavity 640 may extend through the intermediate-post fitting 600 in a direction generally parallel to the front surface 602 of the intermediate-post fitting 600. When the cable 262 is extended through the cavity 640, the cable 262 may be surrounded by the intermediate-post fitting 600 to retain the cable 262 therein.

Unlike the aperture 440 in the end-post fitting 400 (see, e.g., FIG. 5), the cavity 640 in the intermediate-post fitting 600 may be hourglass or bowtie-shaped. More particularly, the cavity 640 may include terminal portions 642 positioned and located adjacent to the terminal ends 644 of the cavity 640 and a central bore 646 positioned and located between the terminal portions 642. For example, the central bore 646 may be positioned and location in between two terminal portions 642.

In the terminal portions 642, the cavity 640 may taper in size, forming a bugle or a cone shape, which may serve as an entrance/exit for receiving the cable 262 within the intermediate-post fitting 600. In the central bore 646, the cavity 640 may be substantially uniform in size. More particularly, the cross-section of the cavity 640 may decrease in size as the cavity 640 extends from the terminal ends 644 toward the central bore 646. However, in the central bore 646, the cross-section of the cavity 640 may be uniform. In addition, the cross-section of the cavity 640—may be shaped differently in the central bore 646 than in the terminal portions 642. For example, in the terminal portions 642, the cross-section of the cavity 640 may be substantially rectangular, while in the central bore 646, the cross-section of the cavity 640 may be substantially circular. As a result, the cavity 640 may be substantially bowtie-shaped.

Figure 10:
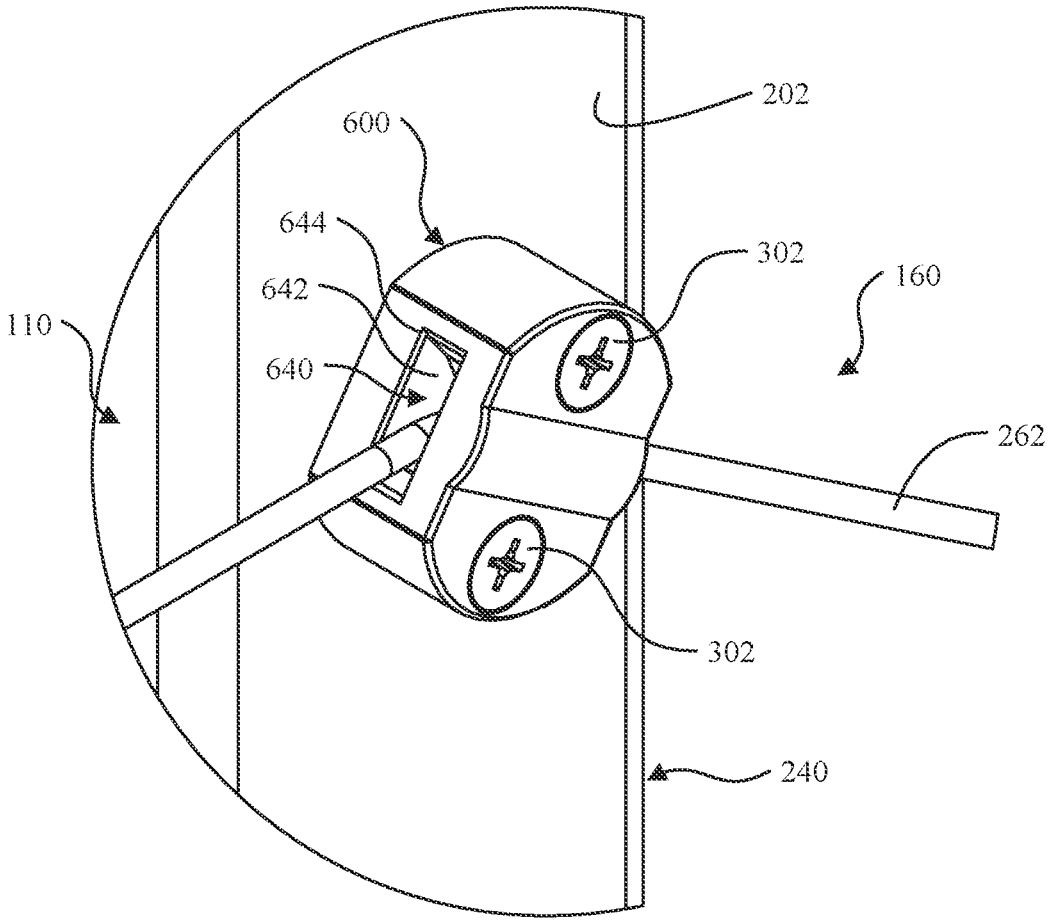
FIG. 10 illustrates an enlarged view of a staircase post of the deck assembly of FIGS. 1 and 2 with the intermediate-post fitting of FIGS. 8 and 9 mounted thereon.

As illustrated in FIG. 10, the intermediate-post fitting 600 may also couple a cable 262 to the staircase post 240. Similarly to the intermediate post 230 (see FIG. 8), the intermediate-post fitting 600 may be coupled to the outer surface 202 of the staircase post 240 by one or more fasteners 302. However, in alternative embodiments, the intermediate-post fitting 600 may be coupled to the staircase post 240 using other suitable means.

As the cable 262 extends through the cavity 640 in the intermediate-post fitting 600, the intermediate-post fitting 600 may guide the cable 262 down the staircase 160 of the deck assembly 100 (see FIGS. 1 and 2). More particularly, the shape of the intermediate-post fitting 600 may gradually bend or curve the cable 262 so that the cable 262 transitions from a generally horizontal orientation to a slanted orientation without a termination of a cable run. For example, the cone shaped terminal portions 642 may allow the cable 262 to gradually change direction before and after extending through the central bore 646 (see FIG. 9) of the cavity 640. Thus, the intermediate-post fitting 600 may guide the cable 262 to transition from one orientation to another, and the cable 262 may extend along the outer perimeter 102 of both of the platform 110 and the staircase 160 of the deck assembly 100.

Figure 11:
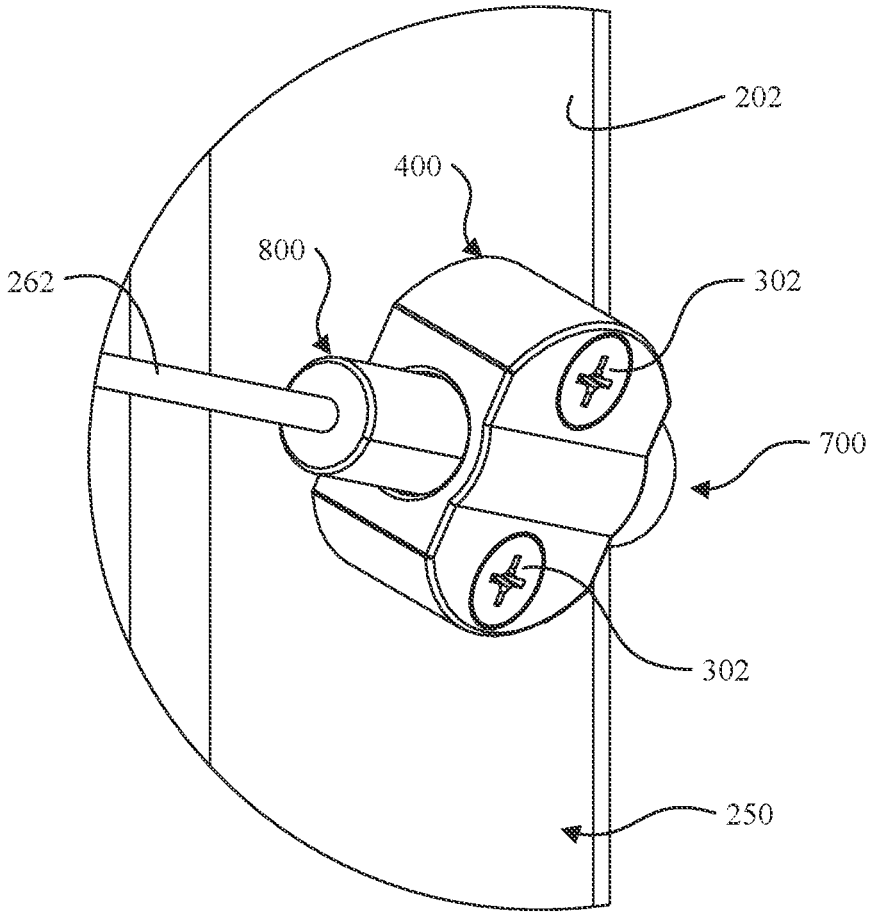
FIG. 11 illustrates an enlarged view of a second end post of the deck assembly of FIGS. 1 and 2 with a non-tensioning fitting mounted thereon.

As illustrated in FIG. 11, a cable 262 may be coupled to the second end post 250 by a non-tensioning fitting 700. Similarly to the tensioning fitting 300 (see, e.g., FIG. 3), the non-tensioning fitting 700 may include an end-post fitting 400 coupled to second end post 250 by one or more fasteners 302. However, unlike the tensioning fitting 300, the cable 262 may be coupled to the non-tensioning fitting 700 by a locking member 800.

Turning to FIG. 12, the locking member 800 may be a tubular member extending from a first end 802 to a second end 804. For example, the locking member 800 may include an inner diameter 810 extending through the locking member 800 from the first end 802 to the second end 804. The inner diameter 810 may be shaped and sized similar to the cable 262 (see, e.g., FIG. 11). As a result, the cable 262 may be inserted into the inner diameter 810, and the locking member 800 may retain the cable 262 in the inner diameter 810. For example, in some embodiments, the cable 262 may be retained in the locking member 800 by a friction fit. In further embodiments, the cable 262 may be retained in the locking member 800 by one or more ratchet teeth (not illustrated) positioned and located on the inner diameter 810. The ratchet teeth may be wedge-shaped protrusions, and the ratchet teeth may be coupled to a spring mechanism to allow for selective movement. Thus, the ratchet teeth may allow the cable 262 to be inserted into the inner diameter 810, and the ratchet teeth may engage with the cable 262 to retain the cable 262 therein. Furthermore, in some alternative embodiments, the locking member 800 may be swaged or crimped around the cable 262 to couple the cable 262 to the non-tensioning fitting 700.

A base 820 of the locking member 800 may be sized and shaped to be received in the aperture 440 in the end-post fitting 400. The base 820 may be positioned and located proximate to the first end 802 of the locking member 800. In addition, the locking member 800 may include a collar 830 positioned and located proximate to the second end 804, and the locking member 800 may include a flange 840 positioned and located between the base 820 and the collar 830. The base 820, the collar 830, and the flange 840 may each be circular-shaped. The base 820 may include an outer base diameter 822, the collar 830 may include an outer collar diameter 832, and the flange 840 may include an outer flange diameter 842. The outer base diameter 822 is smaller than the aperture 440 in the end-post fitting 400. As a result, the base 820 may be received in the aperture 440 in the end-post fitting 400.

The flange 840 may help to retain the locking member 800 in the aperture 440. More particularly, the outer flange diameter 842 may be larger than the aperture 440 in the end-post fitting 400. Thus, when the base 820 may be positioned and located in the aperture 440, the flange 840 prevents the second end 804 of the locking member 800 from entering the aperture 440. As a result, the flange 840 may be positioned and located adjacent to the end-post fitting 400, and the flange 840 may help to retain the locking member 800 in the aperture 440.

The non-tensioning fitting 700 may additionally include a non-tensioning end cap 710. The non-tensioning end cap 710 may be a cylindrical member, although other shapes for the non-tensioning end cap 710 are also foreseeable. The non-tensioning end cap 710 may be selectively engageable with the second end 804 of the locking member 800 to conceal the second end 804 and to protect the second end 804 from the ambient environment. For example, the non-tensioning end cap 710 may include a cavity 712. The cavity 712 may include a substantially circular cross-section. The cross-section of the cavity 712 is larger than the outer collar diameter 832. Thus, the cavity 712 may be placed onto the collar 830 to conceal the second end 804 of the locking member 800. Moreover, the outer flange diameter 842 may be larger than the cavity 712. Thus, the flange 840 may help to position the non-tensioning end cap 710 on the second end 804 of the locking member 800.

Referring to FIG. 13, a template 900 for installing the cable infill system 260 is illustrated. The template 900 may be a substantially flat plate formed as a unitary component, although other suitable geometries are contemplated. The template 900 may extend from a lower end 902 to an upper end 904. The distance between the lower end 902 and the upper end 904 may be similar to the height of a post 210, 220, 230, 240, 250.

In addition, a first side 910 and a second side 920 of the template 900 may extend from the lower end 902 to the upper end 904, and the first side 910 and the second side 920 may be positioned and located opposite from one another on the template 900. The first side 910 and the second side 920 may each include a plurality of cutouts 912, 922, respectively. The cutouts 912, 922 may be about equally spaced along the template 900 from the lower end 902 to the upper end 904. Furthermore, the cutouts 912 on the first side 910 may be semi-circular-shaped, and the cutouts 922 on the second side 920 may be rectangular-shaped. However, in alternative embodiments, the cutouts 912, 922 may be alternatively shaped (such as a stadium-shaped).

Moreover, each of the cutouts 912 on the first side 910 may be sized to receive an end-post fitting 400 or an intermediate-post fitting 600. More particularly, the cutouts 912 may be sized and shaped to abut the end portions 420 of an end-post fitting 400 or the end portions 620 of an intermediate-post fitting 600. Thus, the template 900 may be placed on an end post 210, 250, on an intermediate post 230, or on a staircase post 240, and one or more end-post fittings 400 or intermediate-post fittings 600 may be placed into the cutouts 912 to quickly and precisely position the cable infill system 260 on the post 210, 230, 240, or 250.

Furthermore, each of the cutouts 922 on the second side 920 may be sized to receive a corner-post fitting 500. More particularly, each of the cutouts 922 may be sized and shaped to abut the lower end 530 and the upper end 532 of one of the legs 510, 520 of a corner-post fitting 500. Thus, the template 900 may be positioned and located on an outer surface 202 of a corner post 220, and corner-post fittings 500 may be placed into the cutouts 922 to quickly and precisely position the cable infill system 260 on the corner post 220.

Referring to FIG. 14, another embodiment of a template 1000 for installing the cable infill system 260 is illustrated. Similarly to the template 900 (see FIG. 13), the template 1000 may be substantially flat, although other suitable geometries are contemplated. In addition, the template 1000 may extend from a lower end 1002 to an upper end 1004.

The template 1000 may be a modular component. For example, the template 1000 may include an end module 1010 positioned and located proximate to each of the lower end 1002 and the upper end 1004. In addition, the template 1000 may include one or more intermediate modules 1020 positioned and located between the end modules 1010. Each of the modules 1020 may be positioned and located adjacent to one another, and the modules 1010, 1020 may be selectively engageable with one another. As a result, the height of the template 1000 may be adjustable by adding or removing intermediate modules 1020. In addition, each of the modules 1020 may include a fastening hole 1022 extending through the template 1000. As a result, one or more fasteners may be used to secure the template 1000 during the installation process.

To assist with installing the cable infill system 260, the template 1000 may include a plurality of cutouts 1030. Each of the cutouts 1030 may be a circular opening extending through the template 1000. However, in alternative embodiments, the cutouts 1030 may be alternatively shaped (e.g., rectangular-shaped, stadium-shaped, etc.). Each of the cutouts 1030 may be about equally spaced along the template 1000 from the lower end 1002 to the upper end 1004. For example, each of the cutouts 1030 may be positioned and located at an interface between two of the modules 1010 or 920. Moreover, each of the cutouts 1030 may be sized to receive an end-post fitting 400. Thus, the template 1000 may be coupled to an outer surface 202 of an end post 210, 250, and one or more end-post fittings 400 may be inserted into the cutouts 1030 to quickly and precisely align the cable infill system 260 on the end post 210 or 250.

In alternative embodiments, the cable infill system 260 may be configured to further ease the installation process and to increase efficiency. For example, in the cable infill system 260 illustrated in FIGS. 1-12, each cable 262 may be coupled to the posts 210, 220, 230, 240, 250 by a separate fitting 300, 500, 600, 700, and each of the fittings 300, 500, 600, 700 may individually coupled to the post 210, 220, 230, 240, 250. However, in alternative embodiments, the fittings for a post may be coupled together. For example, in some alternative embodiments, a unitary component (e.g., a stamped or molded bar) may include a plurality of fittings, and the unitary component may be coupled to a post. Thus, in alternative embodiments, the installer may fasten fewer individual pieces to the posts, and the installer may not need to align the fittings relative to one another on a post.

In other alternative embodiments of the cable infill system 260, the fittings may be alternatively positioned and located on the posts. In some such embodiments, the end-post fittings and the intermediate-post fittings may include a rear face that is L-shaped. As a result, each of the end-post fittings and each of the intermediate-post fittings may be positioned and located on the outer surface of a post and on a surface adjacent to the outer surface. Furthermore, in other embodiments, the end-post fittings, the intermediate-post fittings, and the corner-post fittings may include a rear face that is U-shaped. As a result, each of the end-post fittings, intermediate-post fittings, and corner-post fittings may be positioned and located on the outer surface of a post and on two surfaces adjacent to the outer surface. Thus, in alternative embodiments, the end-post fittings, the intermediate-post fittings, and the corner post fittings may be coupled to two or more surfaces of the posts.

Specific embodiments of cable infill systems and templates according to the subject disclosure have been described for the purpose of illustrating the manner in which the invention may be made and used. It should be understood that the implementation of other variations and modifications of this invention and its different aspects will be apparent to one skilled in the art, and that this invention is not limited by the specific embodiments described. Features described in one embodiment may be implemented in other embodiments. The subject disclosure is understood to encompass the subject disclosure and any and all modifications, variations, or equivalents that fall within the spirit and scope of the basic underlying principles disclosed and claimed herein.

What is claimed is:

1. A cable infill system comprising:

a first end-post fitting configured to receive a first tensioning fitting or a first non-tensioning fitting for receiving a cable, wherein the first end-post fitting is configured to be mounted on an outer surface of a first end-post of a railing assembly; and a corner-post fitting configured to guide the cable around a corner post of the railing assembly, wherein the corner-post fitting comprising a first leg and a second leg, wherein the first leg is configured to be mounted on a first outer surface of the corner post and the second leg is configured to be mounted on a second outer surface of the corner post, wherein the first leg of the corner-post fitting includes a first fastening hole for receiving a first fastener and the second leg of the corner-post fitting includes a second fastening hole for receiving a second fastener.

2. The cable infill system of claim 1 further comprising:

a second end-post fitting configured to receive a second tensioning fitting or a first non-tensioning fitting for receiving the cable, wherein the second end-post fitting is configured to be mounted on an outer surface of a second end-post of the railing assembly, thereby securing the cable on the railing assembly between the first end-post and the second end-post.

3. The cable infill system of claim 2, wherein the first end-post fitting and the second end-post fitting each comprising an aperture for receiving a tensioning fitting or a non-tensioning fitting; and a fastening hole for receiving a fastener, wherein the aperture and the fastening hole extend through the respective end-post fitting in different directions.

4. The cable infill system of claim 1 further comprising an intermediate-post fitting configured to receive the cable through a cavity of the intermediate-post fitting, wherein the first end-post fitting is configured to be mounted on an outer surface of an intermediate-post of the railing assembly.

5. The cable infill system of claim 4, wherein the cavity of the intermediate-post fitting comprising a central bore provided in between two terminal portions, wherein each of the terminal portions extends from a surface of the intermediate-post fitting toward the central bore, and each of the terminal portions having a decreasing diameter from the surface toward the central bore.

6. The cable infill system of claim 5, wherein the central bore comprises a diameter that is generally uniform throughout a length of the central bore.

7. The cable infill system of claim 4, wherein the intermediate-post fitting further comprising a fastening hole for receiving a fastener, wherein the cavity and the fastening hole extend through the intermediate-post fitting in different directions.

8. A cable infill system comprising:

a first end-post fitting configured to receive a first tensioning fitting or a first non-tensioning fitting for receiving a cable, wherein the first end-post fitting is configured to be mounted on an outer surface of a first end-post of a railing assembly; and a corner-post fitting configured to guide the cable around a corner post of the railing assembly, wherein the corner-post fitting comprising a first leg and a second leg, wherein the first leg is configured to be mounted on a first outer surface of the corner post and the second leg is configured to be mounted on a second outer surface of the corner post;

wherein the first leg of the corner-post fitting includes a first cable opening and the second leg of the corner-post fitting include a second cable opening, wherein a channel is provided between the first cable opening and the second cable opening for receiving the cable within the corner-post fitting.

9. The cable infill system of claim 1 further comprising a template configured to position a plurality of end-post fittings, a plurality of intermediate-post fittings, or a plurality of corner-post fittings on a post of the railing assembly for mounting.

10. A cable infill system comprising:

a first end-post fitting configured to receive a first tensioning fitting or a first non-tensioning fitting for receiving a cable, wherein the first end-post fitting is configured to be mounted on an outer surface of a first end-post of a railing assembly; and a template configured to position a plurality of end-post fittings, a plurality of intermediate-post fittings, or a plurality of corner-post fittings on a post of the railing assembly for mounting, wherein the template is modular and comprising one or more intermediate modules, wherein a length of the template can be adjusted by adding or removing the one or more intermediate modules.

11. A method for a cable infill system comprising:

providing a first end-post fitting configured to receive a first tensioning fitting or a first non-tensioning fitting for receiving a cable, wherein the first end-post fitting is configured to be mounted on an outer surface of a first end-post of a railing assembly; and providing a corner-post fitting configured to guide the cable around a corner post of the railing assembly, wherein the corner-post fitting comprising a first leg and a second leg, wherein the first leg is configured to be mounted on a first outer surface of the corner post and the second leg is configured to be mounted on a second outer surface of the corner post.

12. The method of claim 11 further comprising:

providing a second end-post fitting configured to receive a second tensioning fitting or a first non-tensioning fitting for receiving the cable, wherein the second end-post fitting mount is configured to be mounted on an outer surface of a second end-post of the railing assembly, thereby securing the cable on the railing assembly between the first end-post and the second end-post.

13. The method of claim 11 further comprising:

providing an intermediate-post fitting to be mounted on an outer surface of an intermediate-post of the railing assembly, wherein the intermediate-post fitting includes a cavity to receive the cable therethrough.

14. The method of claim 13, wherein the cavity of the intermediate-post fitting comprising a central bore provided in between two terminal portions, wherein each of the terminal portions extends from a surface of the intermediate-post fitting toward the central bore, and each of the terminal portions having a decreasing diameter from the surface toward the central bore.

15. The method of claim 11 further comprising:

providing a template configured to position a plurality of end-post fittings, a plurality of intermediate-post fittings, or a plurality of corner-post fittings on a post of the railing assembly for mounting.

16. A method for a cable infill system comprising:

providing a first end-post fitting configured to receive a first tensioning fitting or a first non-tensioning fitting for receiving a cable, wherein the first end-post fitting is configured to be mounted on an outer surface of a first end-post of a railing assembly; and providing a template configured to position a plurality of end-post fittings, a plurality of intermediate-post fittings, or a plurality of corner-post fittings on a post of the railing assembly for mounting;

wherein the template is modular and comprising one or more intermediate modules, wherein a length of the template can be adjusted by adding or removing the one or more intermediate modules.

* * * * *